US005630458A

United States Patent [19]

Holden

[11] Patent Number: 5,630,458

[45] Date of Patent: May 20, 1997

[54] SYSTEM FOR CHILDPROOFING WINDOW CLOSURES

[76] Inventor: Miles A. Holden, 1275 Sliverspear Rd. Apt 203, Mississauga, On, Canada, L4Y 2W7

[21] Appl. No.: 628,526

[22] Filed: Apr. 5, 1996

[51] Int. Cl.[6] ..... E06B 9/30

[52] U.S. Cl. ..... 160/178.1; 24/334; 24/459; 248/227.1

[58] Field of Search ..... 160/178.1 R, 173 R, 160/168.1 R, 176.1 R, 177 R, 178.2 R; 24/334, 132 R, 459, 499, 500; 248/51, 52, 227.3, 227.4, 227.1, 227.2

[56] References Cited

U.S. PATENT DOCUMENTS

| | | | |
|---|---|---|---|
| 1,420,654 | 6/1922 | Grant | 24/334 X |
| 2,499,517 | 3/1950 | Marini | 24/334 X |
| 2,506,783 | 5/1950 | Fauteux | 24/334 X |
| 2,526,810 | 10/1950 | Curtis | 24/334 X |
| 3,485,285 | 12/1969 | Anderle | 160/173 R X |
| 4,909,298 | 3/1990 | Langhart et al. | 160/178.1 R |

*Primary Examiner*—David M. Purol

[57] ABSTRACT

The present invention relates to a system for use in child proofing a window closure. In its broadest context, the system of present invention includes a set of blinds, either vertical or horizontal, which are controlled by a first and second cord. The distal ends of these cords are kept from contacting the ground, or otherwise being in close proximity to the ground, by a clip. This clip includes a first half which is spring biased towards a second half.

4 Claims, 3 Drawing Sheets

FIG 1
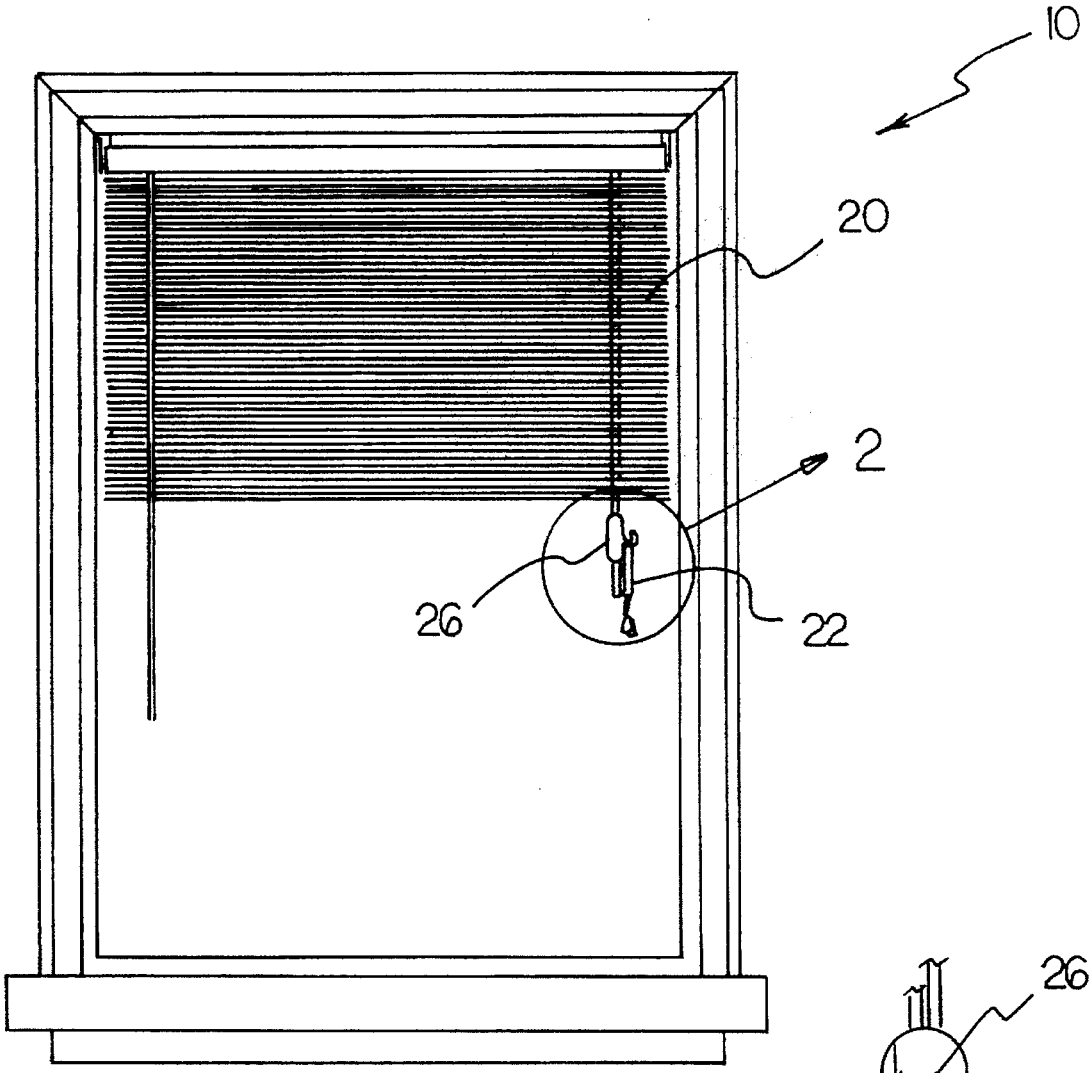
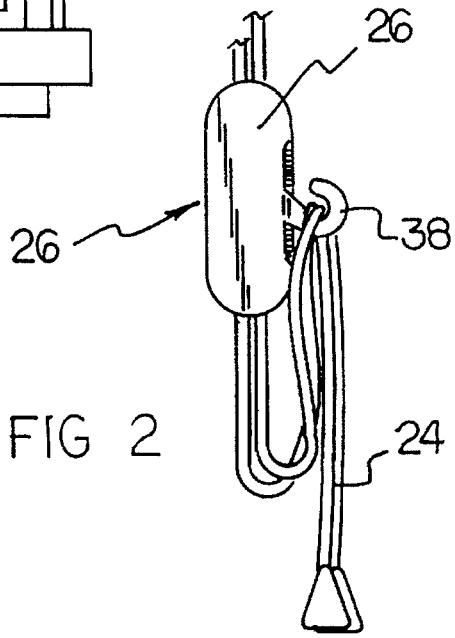
FIG 2

46

26
32
34
42
48
42
36
38
28
44
38
44

SYSTEM FOR CHILDPROOFING WINDOW CLOSURES

BACKGROUND OF THE INVENTION

1. Field of the Invention

The present invention relates to system for childproofing window closures and more particularly pertains to a cord shortening clip.

2. Description of the Prior Art

The use of cord holding clips is known in the prior art. More specifically, cord holding clips heretofore devised and utilized for the purpose of holding cords are known to consist basically of familiar, expected, and obvious structural configurations, notwithstanding the myriad of designs encompassed by the crowded prior art which has been developed for the fulfillment of countless objectives and requirements.

U.S. Pat. No. 4,909,298 to Langhart et al. discloses a window covering cord pull safety device. U.S. Pat. No. 5,125,447 to Suggs discloses a safety device for window decoration cords. U.S. Pat. No. Des. 309,859 to Lysgarrd discloses a cord holding clip. U.S. Pat. No. 4,366,852 to Holzer discloses a cord weight assembly. Lastly, U.S. Pat. No. 4,411,044 to Volfson discloses a cord weight pulley.

In this respect, the system for childproofing window closures according to the present invention substantially departs from the conventional concepts and designs of the prior art, and in doing so provides an apparatus primarily developed for the purpose of shortening cords.

Therefore, it can be appreciated that there exists a continuing need for new and improved system for childproofing window closures which can be used for shortening cords associated with window closures. In this regard, the present invention substantially fulfills this need.

SUMMARY OF THE INVENTION

In view of the foregoing disadvantages inherent in the known types of cord holding clips now present in the prior art, the present invention provides an improved system for childproofing window closures. As such, the general purpose of the present invention, which will be described subsequently in greater detail, is to provide a new and improved system for childproofing window closures and method which has all the advantages of the prior art and none of the disadvantages.

To attain this, the present invention essentially comprises a system for use in child proofing a window closure. The system includes a plurality of window covering elements each of which are supported adjacent a window by two cords. Namely, a first cord supporting a first half of the window covering and a second cord supporting a second half of the window covering. The first and second cords each have distal ends for use in adjusting the plurality of window covering elements. The distal ends of the first and second cords facilitate the adjustment of the plurality of window covering elements inbetween a first orientation wherein the plurality of window covering elements cover substantially the entire window, and a second orientation wherein the plurality of window covering elements are suspended substantially above the window. The clamp associated with the system includes a first half and a second half with each of the halves including a ridged interior surface and a rounded exterior surface, a first side, a second side, an upper rounded edge and a lower rounded edge. Additionally, each of the sides has an upper extent, a lower extent and an intermediate extent therebetween. Each half further includes a J-shaped hook having a base edge, wherein the base edge is integral with the intermediate extent of the first side. Each half also include a pair of eyelets. More specifically, a first eyelet is secured to the upper extent of the first side, a second eyelet is secured to the lower extent of the first side. The first and second halves of the clamp are interconnected such that the first eyelet of the first half comes into contact with the first eyelet of the second half, and the second eyelet of the first half comes into contact with the second eyelet of the second half with the interior surfaces of each half brought into facing relation. A spring is positioned through each of the eyelets, and a dowel is positioned through each of the eyelets. This spring serves to bias the two halves into facing relation. The interior surfaces of each of the halves is adapted to be secured upon the distal ends of the cords with a portion of each of the cords being draped over each of the J-hooks.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved system for childproofing window closures which have all the advantages of the prior art cord shortening clips and none of the disadvantages.

It is another object of the present invention to provide new and improved system for childproofing window closures which may be easily and efficiently manufactured and marketed.

It is further object of the present invention to provide new and improved system for childproofing window closures which are of durable and reliable constructions.

An even further object of the present invention is to provide new and improved system for childproofing window closures which are susceptible of a low cost of manufacture with regard to both materials and labor, and which accordingly are then susceptible of low prices of sale to the consuming public, thereby making such system for childproofing window closures economically available to the buying public.

Still yet another object of the present invention is to provide new and improved system for childproofing window closures which provide in the apparatuses and methods of the prior art some of the advantages thereof, while simultaneously overcoming some of the disadvantages normally associated therewith.

Even still another object of the present invention is to enable users to shorten cords associated with window closures.

Lastly, it is an object of the present invention to provide new and improved a system for use in child proofing a window closure. In its broadest context, the system of present invention includes a set of blinds, either vertical or horizontal, which are controlled by a first and second cord. The distal ends of these cords are kept from contacting the ground, or otherwise being in close proximity to the ground, by a clip. This clip includes a first half which is spring biased towards a second half.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevational view of the preferred embodiment of the system for childproofing window closures constructed in accordance with the principles of the present invention.

FIG. 2 is a view of the clamp associated with the present invention.

The same reference numerals refer to the same parts through the various Figures.

DESCRIPTION OF THE PREFERRED EMBODIMENT

Figure 3:
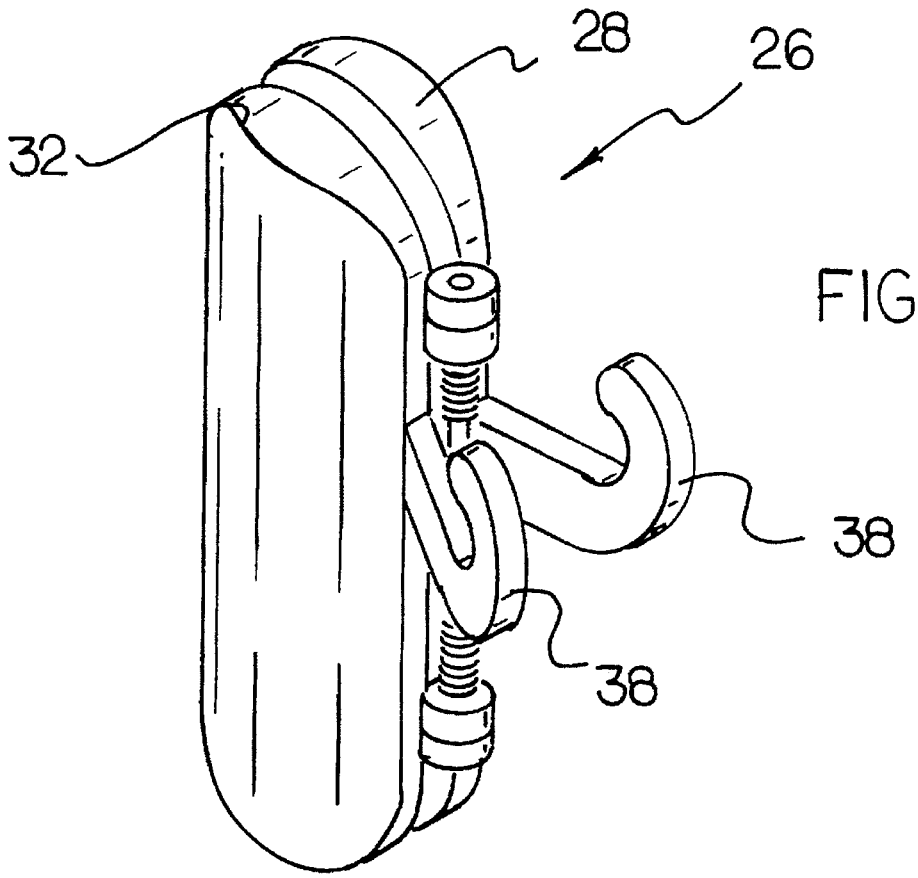
FIG. 3 is a perspective view of the clamp associated with the present invention.

With reference now to the drawings, and in particular to FIG. 1 thereof, the preferred embodiment of the new and improved system for childproofing window closures embodying the principles and concepts of the present invention and generally designated by the reference numeral will be described.

The present invention relates to a system for use in child proofing a window closure. In its broadest context, the system of present invention includes a set of blinds, either vertical or horizontal, which are controlled by a first and second cord. The distal ends of these cords are kept from contacting the ground, or otherwise being in close proximity to the ground, by a clip. This clip includes a first half which is spring biased towards a second half. The various components of the present invention, and the manner in which they interrelate, will be described in greater detail hereinafter.

The window covering associated with the present invention includes a plurality of individual window covering elements 20. These elements can either be vertically or horizontally arranged. The elements depicted in FIG. 1 are horizontally arranged. Each of these elements is supported adjacent the window by two cords 22. More specifically, a first cord serves to support a first half of the window covering and a second cord serves to support a second half of the window covering. Although two such cords 22 have been specified in the preferred embodiment any number of such cords 22 can be employed. The first and second cords 22 each have a distal end for use in adjusting the plurality of window covering elements 20. Thus, the distal ends 24 of the first and second cords 22 facilitate the adjustment of the plurality of window covering elements 20 inbetween a first orientation wherein the plurality of window covering elements 20 cover substantially the entire window, and a second orientation where the plurality of window covering elements 20 are suspended substantially above the window. As can be understood with reference to FIG. 1, in the second orientation a substantial length of each of the cords 22 is left dangling in front of the window. Furthermore, any of the other infinite adjustment levels in between the first and second orientations leaves some degree of the cords 22 positioned in front of the window. The system of the present invention utilizes a clamp 26, or clip, in order to better control the length of these cords 22.

Figure 4:
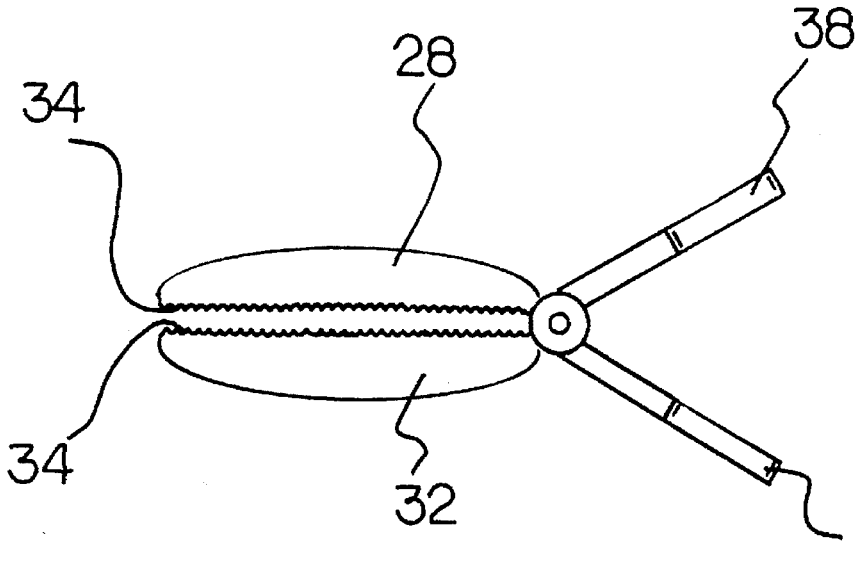
FIG. 4 is a plan view of the clamp associated with the present invention.
Figure 5:
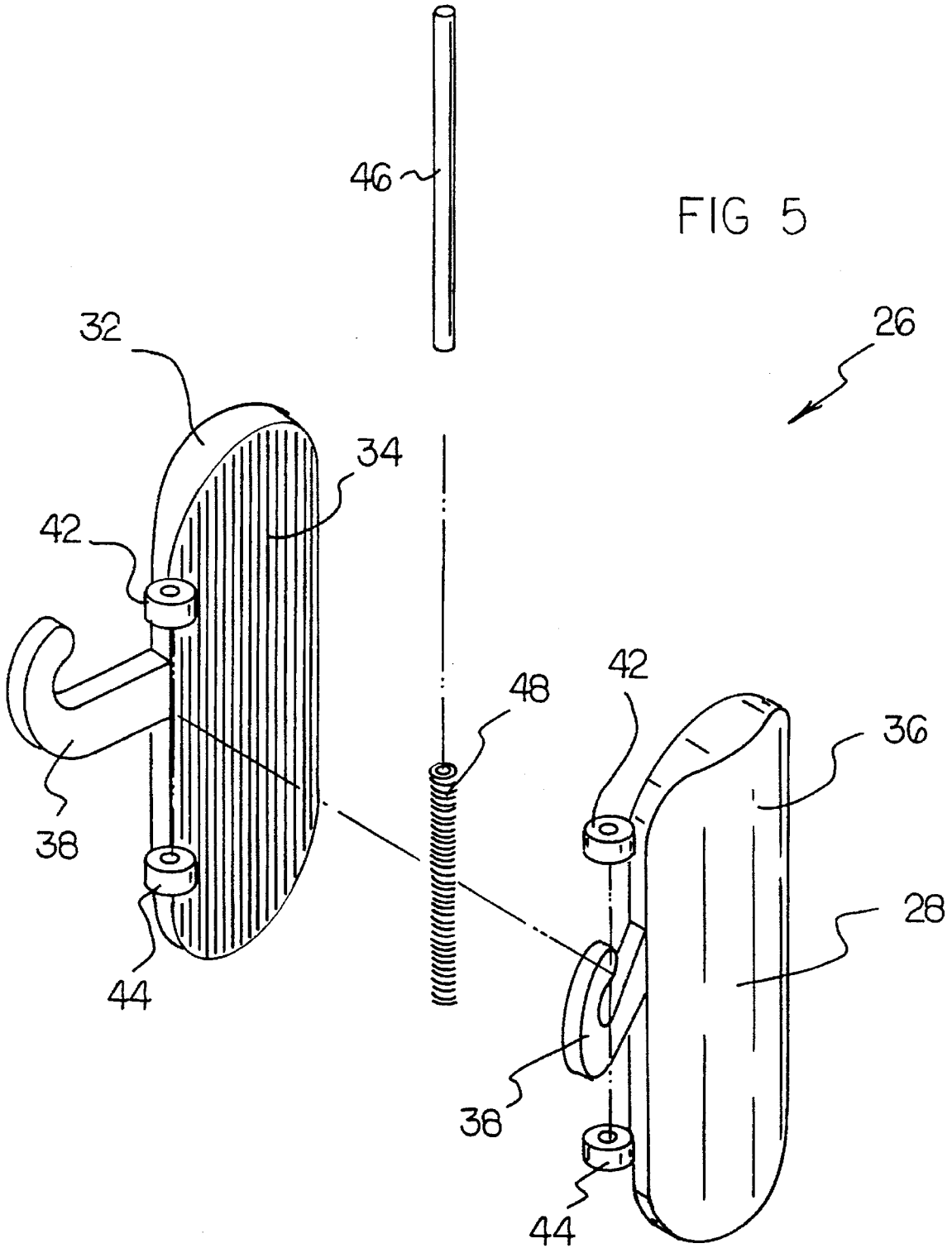
FIG. 5 is an exploded view of the clamp associated with the present invention.

The clamp 26 associated with the system of the present invention includes a first half 28 and a second half 32. Each of the halves are identical to one another, thus only one half of the clamp 26 will be described in detail. The half includes a ridged interior surface 34 and a rounded exterior surface 36. The ridged interior surface 34 facilitates a better securement of the cords 22 in between the clamp 26. Furthermore, the rounded exterior surface 36 makes the clamp 26 free of any undue sharp corners. The half further includes a first side, a second side, an upper rounded edge and a lower rounded edge. Each of the sides is defined by an upper extent, a lower extent and an intermediate extent therebetween. A J-shaped hook 38, which is partially defined by a base edge, is integral with the clamp 26. More specifically, the base edge of the J-hook 38 is integral with the intermediate extent of the first side. The J-hook 38 is oriented such that it makes approximately a 30 degree angle with respect to the interior surface of the half. This arrangement is most clearly seen with reference to FIG. 4. Furthermore, a first eyelet 42 is secured to the upper extent of the first side, and a second eyelet 44 is secured to the lower extent of the first side. These eyelets are employed in securing the two halves of the clamp 26 to one another.

The first and second halves of the clamp 26 are interconnected such that the first eyelet 42 of the first half 28 comes into contact with the first eyelet 42 of the second half 32 and the second eyelet 44 of the first half 28 comes into contact with the second eyelet 44 of the second half 32. In this arrangement, the interior surfaces of each half are brought into facing relation. Furthermore, a spring 48 is positioned through each of the eyelets with each of its ends being secured to the outer eyelets. For additional rigidity, a dowel 46 is positioned through each of the eyelets. Thus, the dowel 46 serves to pivotally interconnect the two halves of the clamp 26 by way of the eyelets. Additionally, the spring 48 serves to bias the two halves into facing relation.

In use, the interior surfaces of each of the halves are adapted to be secured upon the distal ends of the cords. This attachment of the clamp to the distal ends can be achieved anywhere along their lengths. The remaining portion of the cords can then be draped over each of the J-hooks. Thus, the clamp serves to, in essence, shorten the length of the distal ends of the cords. In this manner, the clamp removes the cords from the reach of any infants or toddlers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system for use in child proofing a window closure, the system comprising in combination:

a plurality of window covering elements being supported adjacent a window by two cords, wherein a first cord supports a first half of the window covering and a second cord supports a second half of the window covering, the first and second cords each having distal ends for use in adjusting the plurality of window covering elements, the distal ends of the first and second cords facilitating the adjustment of the plurality of window covering elements in between a first orientation wherein the plurality of window covering elements cover substantially the entire window and a second orientation where the plurality of window covering elements are suspended substantially above the window;

a clamp having a first half and a second half with each half having a ridged interior surface and a rounded exterior surface, a first side, a second side, an upper rounded edge and a lower rounded edge, each of the sides having an upper extent, a lower extent and an intermediate extent therebetween, a J-shaped hook having a base edge, the base edge integral with the intermediate extent of the first side, a first eyelet secured to the upper extent of the first side, a second eyelet secured to the lower extent of the first side;

the first and second halves of the clamp interconnected such that the first eyelet of the first half comes into contact with the first eyelet of the second half and the second eyelet of the first half comes into contact with the second eyelet of the second half and the interior surfaces of each half are brought into facing relation, a spring positioned through each of the eyelets, a dowel positioned through each of the eyelets, the spring serving to bias the two halves into facing relation;

the interior surfaces of each of the halves adapted to be secured upon the distal ends of the cords with a portion of each of the cords being draped over each of the J-hooks.

2. A system for use in child proofing a window closure, the system comprising in combination:

a first and a second cord for use in controlling a window covering, each of the cords having a distal end;

a clamp having a first half and a second half with each half having a interior surface and an exterior surface, a first side, a second side, an upper edge and a lower edge, each of the sides having an upper extent, a lower extent and an intermediate extent therebetween, a J-shaped hook having a base edge, the base edge integral with the intermediate extent of the first side, a first eyelet secured to the upper extent of the first side, a second eyelet secured to the lower extent of the first side;

the first and second halves of the clamp interconnected such that the first eyelet of the first half comes into contact with the first eyelet of the second half and the second eyelet of the first half comes into contact with the second eyelet of the second half and the interior surfaces of each half are brought into facing relation, a spring positioned through each of the eyelets, a dowel positioned through each of the eyelets, the spring serving to bias the two halves into facing relation;

the interior surfaces of each of the halves adapted to be secured upon the distal ends of the cords with a portion of each of the cords being draped over each of the J-hooks.

3. The system as described in claim 2 further comprising:

ridges formed upon the interior surfaces of each of the halves.

4. The system as described in claim 2 wherein:

the exterior surfaces of each of the halves is rounded; and the upper and lower edges of each half are rounded.

* * * * *